United States Patent [19]

Salour et al.

[11] 4,408,464

[45] Oct. 11, 1983

[54] DEWAR COOLING CHAMBER FOR SEMICONDUCTOR PLATELETS

[75] Inventors: Michael M. Salour, Cambridge, Mass.; Charles B. Roxlo, Fanwood, N.J.

[73] Assignee: The United States of America as represented by the Secretary of the Air Force, Washington, D.C.

[21] Appl. No.: 361,020

[22] Filed: Mar. 23, 1982

[51] Int. Cl.[3] ..... F25B 19/00

[52] U.S. Cl. ..... 62/514 R; 62/268; 62/383

[58] Field of Search ..... 62/383, 514 R, 100, 62/268; 248/DIG. 1, 550; 165/81

[56] References Cited

U.S. PATENT DOCUMENTS

| | | | |
|---|---|---|---|
| 3,609,992 | 10/1971 | Cacheux | 62/514 R |
| 3,742,729 | 7/1973 | Zulliger | 62/514 R |
| 3,909,225 | 9/1975 | Rooney | 62/514 R |
| 3,978,686 | 9/1976 | Lechner et al. | 62/514 R |
| 3,999,403 | 12/1976 | Bower et al. | 165/81 |
| 4,194,119 | 3/1980 | Mackenzie | 165/81 |

FOREIGN PATENT DOCUMENTS

| | | | |
|---|---|---|---|
| 1585049 | 1/1970 | France | 62/383 |

OTHER PUBLICATIONS

Rotman et al., "Pulse-Width Stabilization of a Synchronously Pumped Mode-Locked Dye Laser," Appl. Phys. Lett., 36 (11), Jun. 1, 1980, pp. 886-888.

*Primary Examiner*—Ronald C. Capossela

*Attorney, Agent, or Firm*—Donald J. Singer; Jacob N. Erlich

[57] ABSTRACT

A Dewar cooling chamber having a mounting assembly therein capable of supporting a semiconductor platelet for translational movement in the x, y axes and tilting movement about the z axis. Cooling of the semiconductor platelet continually takes place even while the platelet is being moved in three dimensions. This cooling is accomplished by means of a flexible, conductive loop of material which interconnects a coolant source to a clamp surrounding the platelet. The clamp fixedly secures the semiconductor platelet to the mounting assembly. The cooling chamber is capable of maintaining the semiconductor platelet at liquid nitrogen temperatures and is therefore extremely useful within a semiconductor laser system.

11 Claims, 4 Drawing Figures

DEWAR COOLING CHAMBER FOR SEMICONDUCTOR PLATELETS

STATEMENT OF GOVERNMENT INTEREST

The invention described herein may be manufactured and used by or for the Government for governmental purposes without the payment of any royalty thereon.

BACKGROUND OF THE INVENTION

This invention relates generally to cooling chambers, and, more particularly, to a Dewar cooling chamber which is capable of mounting semiconductor platelets therein for movement in three dimensions while maintaining the semiconductor crystal at a low temperature.

In recent years the use of semiconductor devices has expanded greatly. An area of particular interest involving semiconductors is the optically pumped semiconductor laser. In fact, recent advances in laser research have led to the development by the inventors of optically pumped semiconductor lasers which incorporate therein an external resonant cavity. Of particular interest are such lasers as described in U.S. patent application Ser. No. 361,021 entitled "Tunable CW Semiconductor Platelet Laser" and U.S. patent application Ser. No. 361,019 entitled "Synchronously Pumped Mode-Locked Semiconductor Laser", both applications being filed together with this patent application by the present inventors.

As clearly pointed out in the above-mentioned U.S. patent applications Ser. No. 361,021 and Ser. No. 361,019, in order to provide optimun outputs, the semiconductor platelets must be cooled to liquid nitrogen temperatures or below. In addition, a threshold of approximately 100 $KW/cm^2$ requires an extremely tight beam focus for CW or quasi-CW lasing because the total power demanded by a larger spot size would be sufficient to destroy the semiconductor crystal. Furthermore, a small spot size is also required to eliminate amplified spontaneous emission. Therefore, it becomes essential to provide a mounting arrangement for the semiconductor crystal which not only allows for precise alignment of the crystal, but also provides sufficient cooling of the crystal to take place.

SUMMARY OF THE INVENTION

The present invention overcomes the problems encountered in the past and as set forth in detail hereinabove by providing a Dewar cooling chamber which is readily adaptable for use with semiconductor devices such as, for example, a semiconductor laser. The Dewar cooling chamber of this invention not only sufficiently cools the semiconductor crystal without adversely affecting lasing, but also allows for appropriate movement in three dimensions of the semiconductor crystal with the stability necessary for laser operation.

Making up the Dewar cooling chamber of this invention is a preferably tubular-shaped vacuum housing having a substantially square cross-section. A pair of end plates seal the tubular housing with one of the end plates having a centrally located opening therein covered by a transparent window to allow a beam of electromagnetic energy to pass therethrough.

The semiconductor platelet crystal utilized with this invention is held securely in place within the cooling chamber, but is also capable of being moved in three dimensions; two translational directions along the x, y axes, respectively, and tilting movement about the z axis by a uniquely designed holder assembly. In order to accommodate the three dimensional movement of the semiconductor, the semiconductor crystal is thermally connected to a coolant reservoir by a flexible, conductive sheet of material.

Since the major utilization of the Dewar cooling chamber of this invention is within an optically pumped semiconductor laser of the type described in U.S. patent applications Ser. No. 361,021 and Ser. No. 361,019 referred to hereinabove, the thin semiconductor platelet lasing medium is mounted directly on a dielectric mirror prior to mounting within the chamber. A 10X microscope objective, capable of spot diameters less than 5 μm is adjustably mounted within the cooling chamber of the present invention for focusing both the pump and semiconductor laser beams.

It is therefore an object of this invention to provide a Dewar cooling chamber capable of adequately cooling a semiconductor platelet as well as mounting a semiconductor platelet therein for three dimensional movement in a vacuum.

It is another object of this invention to provide a Dewar cooling chamber which is readily adaptable for use within a semiconductor laser.

It is a further object of this invention to provide a Dewar cooling chamber which is economical to produce and which utilizes conventional, currently available components that lend themselves to standard, mass producing, manufacturing techniques.

For a better understanding of the present invention, together with other and further objects thereof, reference is made to the following description taken in conjunction with the accompanying drawing and its scope will be pointed out in the appended claims.

DETAILED DESCRIPTION OF THE DRAWING

DETAILED DESCRIPTION OF THE PREFERRED EMBODIMENT

Figure 1:
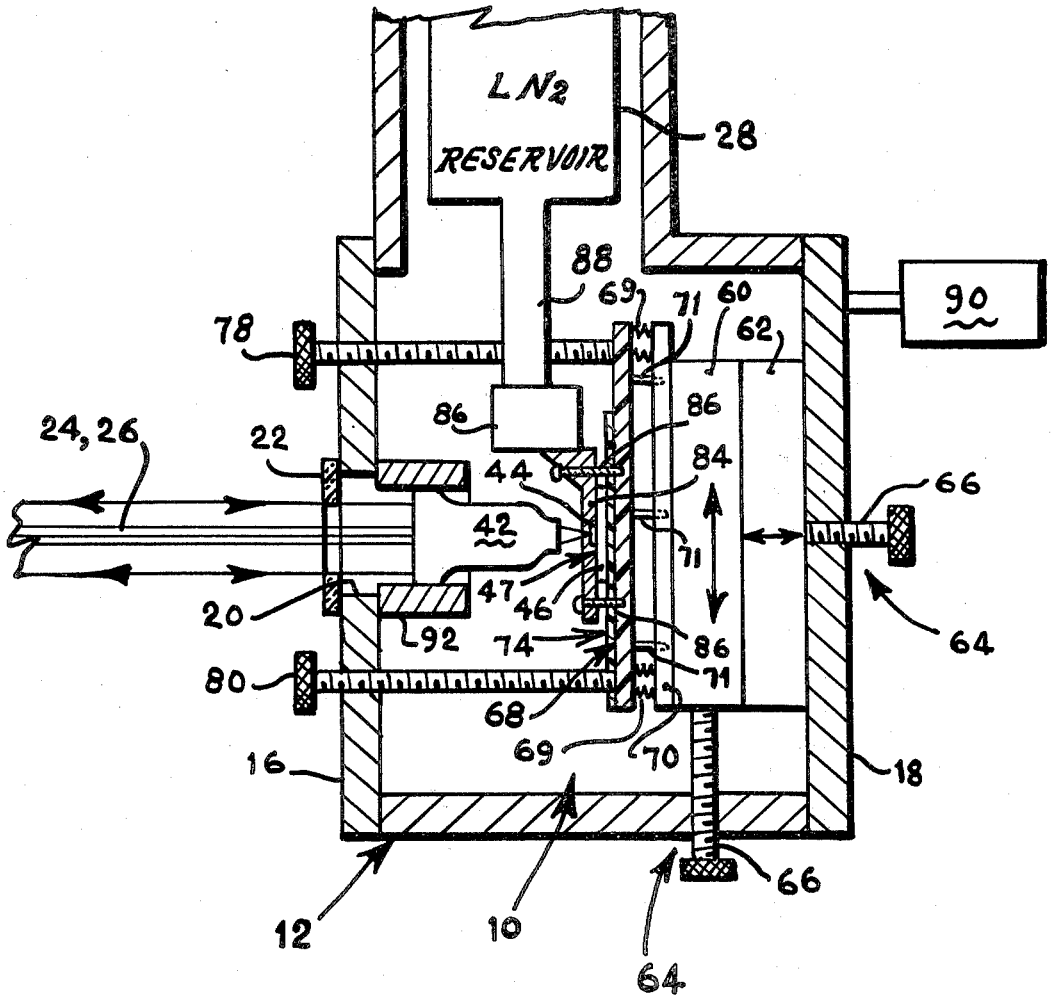
FIG. 1 is a side elevational view of the Dewar cooling chamber of this invention shown partly in cross-section.
Figure 2:
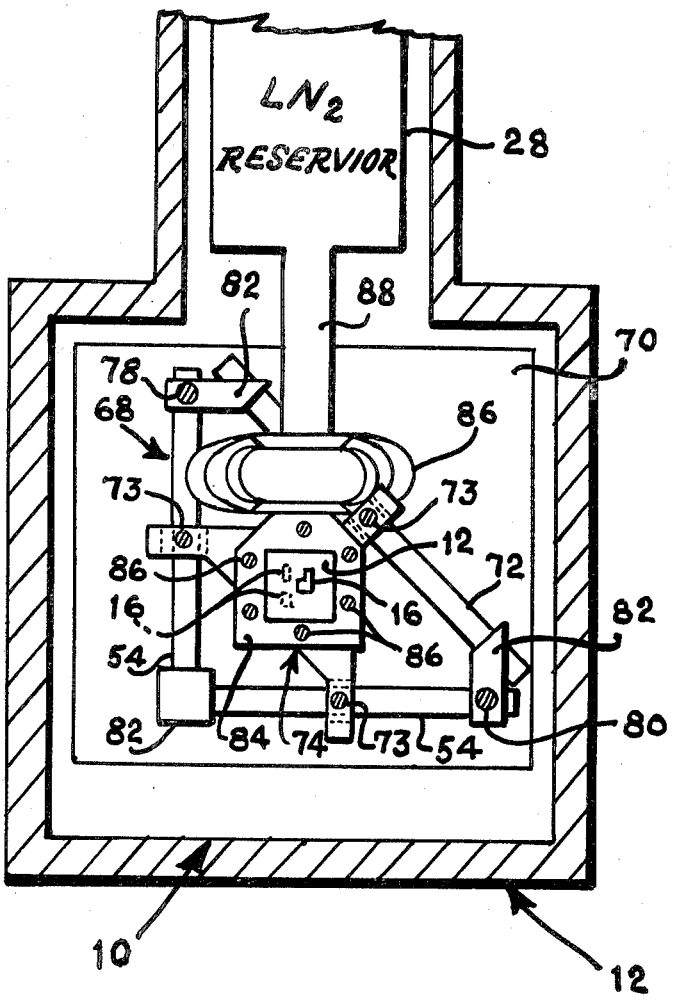
FIG. 2 is a front view of the Dewar cooling chamber of this invention shown partly in cross-section.

Reference is now made to FIGS. 1 and 2 of the drawing which clearly illustrate the Dewar cooling chamber 10 of this invention. Cooling chamber 10 is made up of a housing 12 preferably being of a tubular configuration having a substantially square cross-section as shown in FIG. 2 of the drawing. Although not limited to the following dimensions, optimum outputs can be obtained from laser systems of the type described in U.S. patent applications Ser. No. 361,021 and Ser. No. 361,019 referred to above and described more specifically hereinafter by utilizing cooling chamber 10 of the present invention having such dimensions. For example, chamber 10 can be formed of a stainless steel tube having a square cross-section approximately 15×15 centimeters by 11 centimeters in length having a 1.0 centimeter wall thickness.

A pair of end plates 16 and 18 seal the tube with one of the end plates 16 having a centrally located opening 20 therein covered by a window 22. Window 22 is transparent to the wavelengths of interest so as to permit passage therethrough of both an optical pumping beam 24 and a laser beam 26 in the manner illustrated more clearly in FIGS. 3 and 4 of the drawing. Any conventional coolant reservoir 28 is situated on top of housing 12 and preferably contains liquid nitrogen which is used for cooling purposes.

Figure 3:
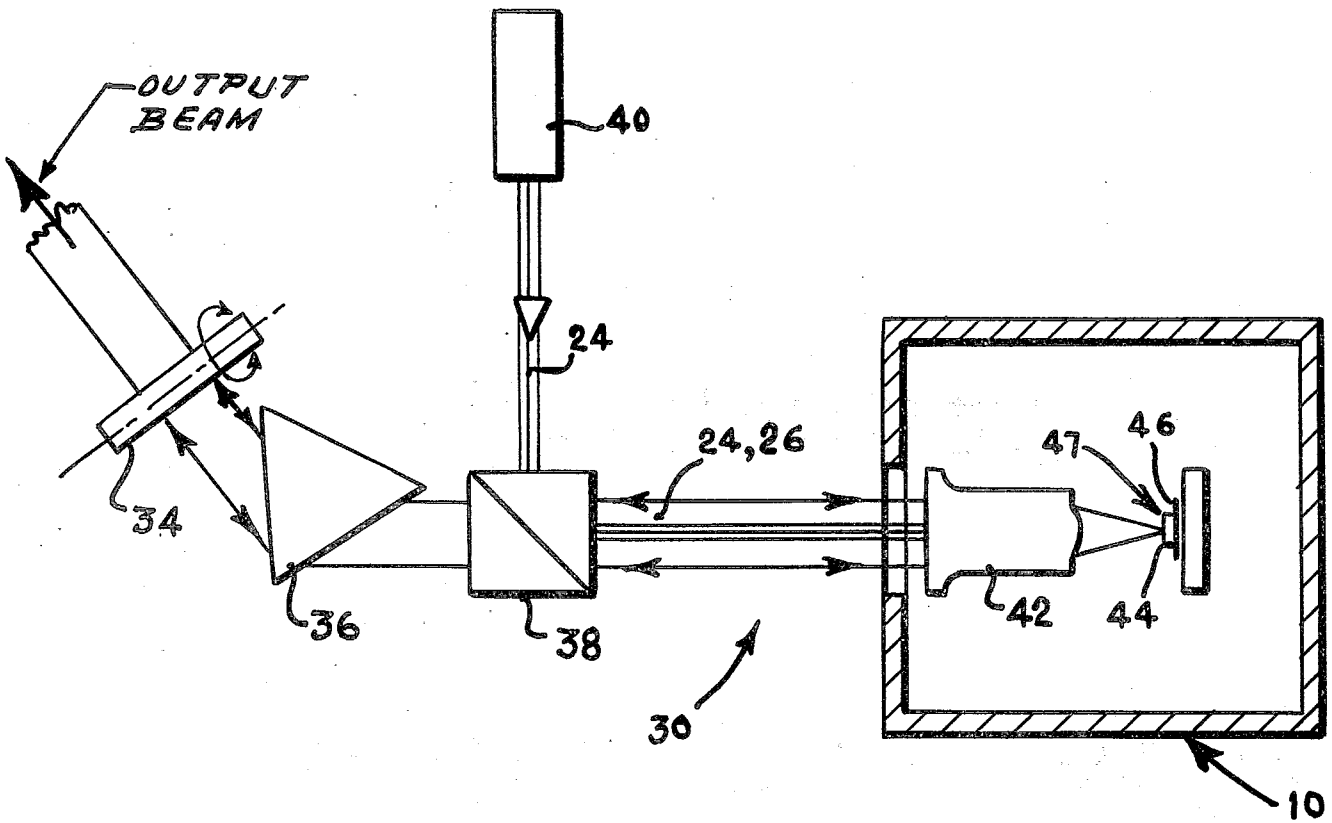
FIGS. 3 and 4 schematically illustrate the Dewar cooling chamber of this invention in use within a semiconductor laser system.
Figure 4:
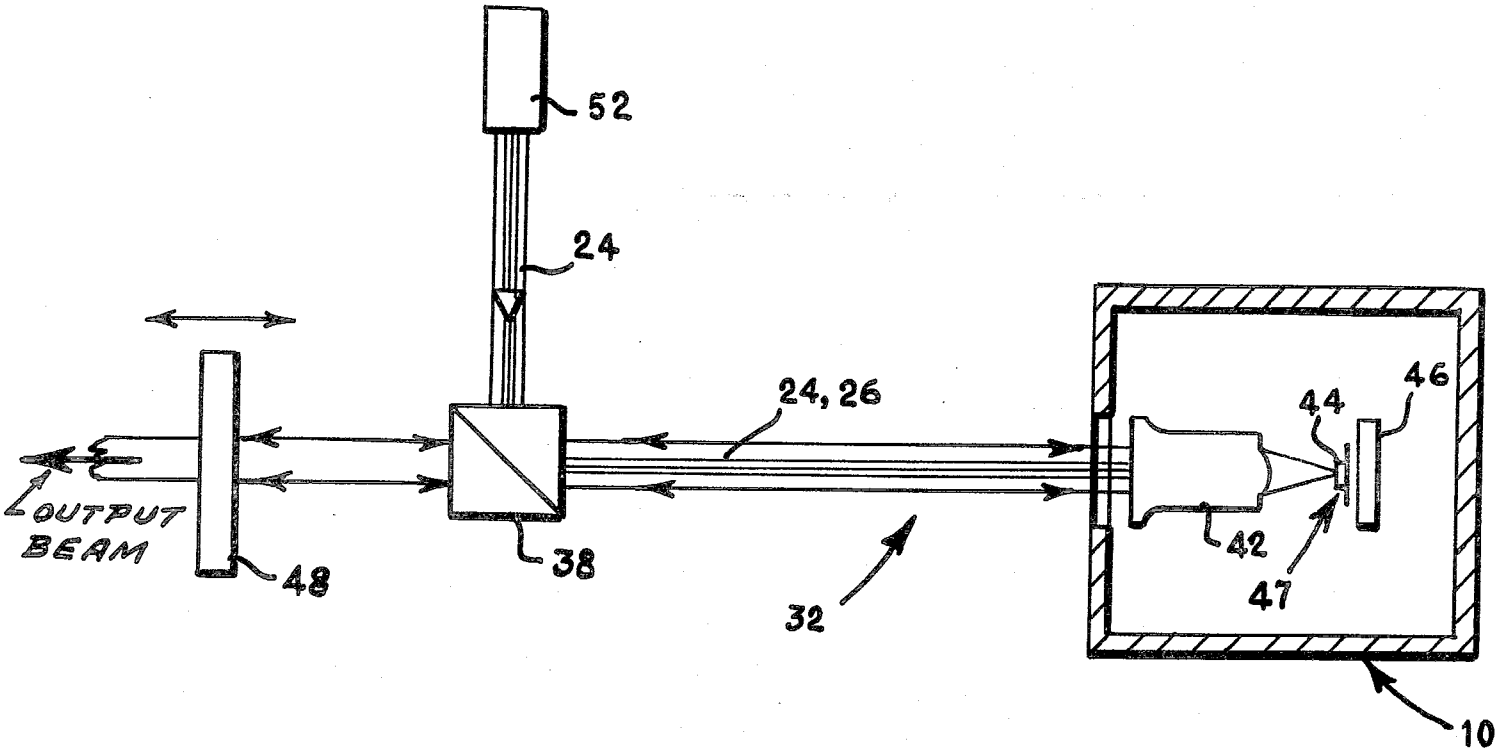

Since the Dewar cooling chamber 10 of this invention finds particular use within a laser system, reference is now made to FIGS. 3 and 4 of the drawing which schematically illustrate typical semiconductor lasers 30 and 32 which incorporate cooling chamber 10 therein. Additionally, for ease of understanding of this invention identical reference numerals will be used in all figures of the drawing to represent the same basic elements. In this manner a fuller understanding of the present invention along with its detailed description set forth below can be made.

FIG. 3 is representative of a tunable CW semiconductor platelet laser 30 of the type more fully described in the above-mentioned U.S. patent application Ser. No. 361,021. Laser utilizes 30 utilities Dewar cooling chamber 10 in conjunction with a rotatable output mirror 34, a prism 36, a polarizing beamsplitter 38, a continuous wave pump source 40 providing pump beam 24, a microscope objective 42, a lasing medium in the form of a semiconductor platelet crystal 44, an end mirror 46 preferably made of sapphire, and laser beam 26.

FIG. 4 is representative of a synchronously pumped mode-locked semiconductor platelet laser 32 of the type more fully described in the above-mentioned U.S. patent application Ser. No. 361,019. Laser 32 utilizes Dewar cooling chamber 10 in conjunction with a translatable output mirror 48, polarizing beamsplitter 38, an actively mode-locked pump source 52 providing pump beam 24, microscope objective 42, a lasing medium in the form of a semiconductor platelet crystal 44, end mirror 46 and laser beam 26.

Although two specific illustrative examples of the use of cooling chamber 10 are given above, it should be noted that these examples are not to be construed as the only use for cooling chamber 10. These examples are only presented so that a complete understanding and appreciation of the components and make-up of cooling chamber 10 of this invention set forth in detail hereinbelow can be had. As shown in FIGS. 3 and 4, both microscope objective 42 and the crystal/mirror sandwich 47 are located within the confines of cooling chamber 10.

Reference is once again made to FIGS. 1 and 2 of the drawing for a detailed description of the cooling and mounting arrangement for semiconductor crystal 44 within cooling chamber 10. Two translational stages 60 and 62, preferably in the form of Klinger model MRS 80 25 are secured to back plate 18 of chamber 10 and crystal/mirror sandwich 47 in a manner described below to allow the translational movement of the crystal/mirror sandwich 47 to take place along the x, y axes in the directions indicated by the arrows shown in FIG. 1. These translational stages 60 and 62 are controlled by conventional micrometer heads 64 located outside of chamber 10 and which protrude through the walls of cooling chamber 10. The spindles 66 of the micrometer heads 64 are pushed directly against the respective sides of translational stages 60 and 62 so as to allow fine adjustment of crystal/mirror sandwich 47 with micron accuracy.

Crystal 44 is mounted upon the reflective surface of sapphire mirror 46 to form the crystal/mirror sandwich 47 which is optically aligned with the pumping and laser beams 24 and 26, respectively. The crystal/mirror sandwich 47 is held in position within chamber 10 by a mounting assembly 68 and a mounting plate 70 preferably made of steel. As clearly illustrated in FIGS. 1 and 2, mounting assembly 68 is in the form of a triangular-shaped structure secured by means of compression springs 69 to mounting plate 70. A plurality of alignment pins 71 maintain alignment between mounting assembly 68 and mounting plate 70. As a result of this arrangement, movement of translational stages 60 and 62 causes movement of mounting assembly 68 to take place. In this manner fine adjustment, in the x, y directions of crystal/mirror sandwich 47 can be performed by appropriate rotation of micrometer heads 64.

The triangular structure of mounting assembly 68 includes a plurality of quartz tubing in order to form a frame 72. A quartz central support 74 is slidably mounted upon frame 72 for coarse adjustment of the crystal/mirror sandwich prior to fine adjustment thereof by micrometer heads 64. A plurality of set screws 73 fixedly secure central support 74 to frame 72 once the coarse adjustment of crystal/mirror sandwich 47 has been accomplished.

Mounting assembly 68 (along with the crystal/mirror sandwich) can be tilted about the z axis with respect to plate 70 by turning a pair of screws 78 and 80 located at the corners of mounting assembly 68 as shown in FIG. 1. The force of adjustment screws 78 and 80 as they are rotated acts against the force of springs 69 thereby providing a stable relationship between mounting assembly 68 and mounting plate 70 while the tilting movement of mounting assembly 68 takes place.

Screws 78 and 80 are connected to vacuum feedthroughs with electroformed nickel bellows (not shown) and can be adjusted while the laser associated therewith is in operation. Quartz tubing is used for the material of mounting assembly 68 because it exhibits low thermal conductivity and very low thermal expansion, minimizing stresses generated when crystal 44 is cooled down. As shown in FIG. 2, three pieces of quartz tubing make up frame 72. The tubing is interconnected by stainless steel connectors 82 to complete mounting assembly 68.

Referring more specifically to the mounting of crystal/mirror sandwich 47, sapphire mirror 46 is clamped to the quartz crystal central support 74 by a stiff copper ring 84 and a plurality of screws 86. A thin sheet of indium (not shown) may be provided between sapphire mirror 46 and copper ring 84 in order to insure a good thermal connection therebetween. The stiff copper clamping ring 84 is soft soldered to a flexible copper loop 86 which is made up of approximately 20 wraps of thin copper sheet. This loop 86 allows movement of mounting plate 70, mounting assembly 68 and crystal/mirror sandwich 47 to take place by more than 1.5 cm.

More particularly, loop 86 is made up of a spiral of a single piece of copper 250 cm×2.5 cm×50 μm brazed together at the top and bottom. The top of the loop 86 is connected to a hollow element 88 operably connected to the liquid nitrogen reservoir 28. Therefore, by feeding the liquid nitrogen into the hollow element the conductive loop 86 transfers this reduced temperature to clamp ring 84. Clamp ring 84 can provide an adequate cooling environment surrounding crystal/mirror sandwich 47 without adversely affecting the lasing ability of semiconductor platelet 44. Additionally, the flexibility of the conductive loop 86 allows adjustment of the crystal/mirror sandwich 47 to take place without disturbing the cooling thereof. It is possible, if so desired, to loosely surround the quartz triangular shaped mounting assembly 68 and copper loop 86 by three layers of "super-insulation" such as aluminized Mylar foil in order to reduce radiated heat losses.

The cooling chamber 10 can be pumped to a pressure of 20 m torr when used in conjunction with a laser before lasing operation commences by any conventional vacuum pump 90. A charcoal dessicant further reduces convection losses. Temperature on mounting assembly 68 can be measured by three platinum RTD detectors (not shown) if desired.

The microscope objective 42 (Leitz EF 10/0.25P) located within cooling chamber 10 is chosen for its relatively low reflection losses, roughly approximately 4% per pass. It is slidably connected by means of outstanding element 92 to front plate 16 of chamber 10. Objective 42 can be moved parallel to the beam 26 for appropriate focusing onto crystal 44 by any conventional means (not shown). Typically, lasing can be accomplished over a range of 200 $\mu$m in the focal distance for a cavity length 1.8 meters.

The cooling chamber 10 of this invention is capable of maintaining crystal 44 at a stable temperature of approximately 82 K. It is capable of cooling down from room temperature in approximately ten minutes, and the 380 ml capacity of the liquid nitrogen reservoir 28 is sufficient to hold the temperature substantially constant for over six hours without refilling.

Although this invention has been described with reference to a particular embodiment, it will be understood that this invention is also capable of further and other embodiments within the spirit and scope of the appended claims.

We claim:

1. A Dewar cooling chamber comprising a housing, said housing forming a chamber therein; means located within said chamber for securely supporting an object and moving said object in three dimensions; and means operably connected to said object supporting and moving means for providing a cooling environment for said object, said cooling means being capable of moving in conjunction with said object in said three dimensions.

2. A Dewar cooling chamber as defined in claim 1 further comprising means for providing a vacuum inside said chamber.

3. A Dewar cooling chamber as defined in claim 1 wherein said object supporting and moving means comprises an object mounting assembly and means for fixedly clamping said object to said mounting assembly, first means operably connected between said housing and said mounting assembly for moving said object translationally along the x, y axes and second means operably connected between said housing and said mounting assembly for moving said object about the z axis.

4. A Dewar cooling chamber as defined in claim 3 wherein said cooling means comprising a coolant source and means made of a flexible conductive material for operably connecting said coolant source to said clamping means surrounding said object.

5. A Dewar cooling chamber as defined in claim 4 wherein said object supporting and moving means further comprises means for securing said mounting assembly to said first moving means, said securing means enabling said mounting assembly to move with said first moving means as well as enabling said mounting means to move with respect to said first moving means whereby said object is capable of moving in the x, y directions in conjunction with said first moving means and about the z axis with respect to said first moving means.

6. A Dewar cooling chamber as defined in claim 5 wherein said cooling means further comprises a hollow element interconnecting said coolant source to said flexible conductive material and said flexible conductive material being in the form of a plurality of loops of conductive material.

7. A Dewar cooling chamber as defined in claim 6 wherein said means for securing said mounting assembly to said first moving means comprises at least two compression springs interconnected between said mounting assembly and said first moving means and means interconnected between said mounting assembly and said first moving means for maintaining appropriate alignment therebetween.

8. A Dewar cooling chamber as defined in claim 7 wherein said mounting assembly comprises a frame and a central support slidably mounted on said frame, said object being secured to said central support by said clamping means whereby course adjustment of the position between said frame and said central support can take place prior to fine adjustment of the position of said object by said first and said second moving means.

9. A Dewar cooling chamber as defined in claim 8 further comprising means for providing a vacuum inside said chamber.

10. A Dewar cooling chamber as defined in claim 9 wherein said housing has an opening adjacent said object and a window sealing said opening.

11. A Dewar cooling chamber as defined in claim 10 further comprises a focusing element in said chamber adjacent said window and means for adjustably mounting said focusing element in said chamber.

* * * * *